US005433249A

United States Patent [19]

Tsubota et al.

[11] Patent Number: 5,433,249

[45] Date of Patent: Jul. 18, 1995

[54] HYDRAULIC PILOT VALVE

[75] Inventors: Hirotaka Tsubota; Mitsuo Kato; Siro Sugiyama, all of Osaka, Japan

[73] Assignee: Kubota Corporation, Osaka, Japan

[21] Appl. No.: 218,606

[22] Filed: Mar. 29, 1994

[30] Foreign Application Priority Data

Aug. 17, 1993 [JP] Japan ..... 5-203388
Aug. 17, 1993 [JP] Japan ..... 5-203389

[51] Int. Cl.[6] ..... F15B 13/02

[52] U.S. Cl. ..... 137/625.68; 137/596.1; 137/636.1; 137/636.2

[58] Field of Search ..... 137/631.1, 636.2, 596.1, 137/625.68

[56] References Cited

U.S. PATENT DOCUMENTS 4,341,243 7/1982 Melocik ..... 137/625.68
4,566,492 1/1986 Bessard ..... 137/636.2 X
5,251,534 10/1993 Yonekubo et al. ..... 137/636.2 X

FOREIGN PATENT DOCUMENTS 3-17386 2/1991 Japan .
1003001 9/1965 United Kingdom .
1483127 8/1977 United Kingdom .
WO81/03685 12/1981 WIPO .

*Primary Examiner*—Gerald A. Michalsky
*Attorney, Agent, or Firm*—Fisher & Associates

[57] ABSTRACT

A crosswise controllable pilot valve for generating a pilot pressure corresponding to an amount of operation of a control lever. This valve has a spool reciprocable within a valve case between a pilot pressure supplying position for interconnecting a pump port and a supply and exhaust port, and an exhaust position for interconnecting a tank port and the supply and exhaust port, and a push rod movable in a first direction within the valve case to move the spool to the supplying position. The push rod includes a cylindrical skirt portion adjacent one end thereof having sliding surfaces for sliding relative to the valve case, and a rod portion adjacent the other end. The skirt portion, rod portion and valve case define a first space, while the skirt portion, spool and valve case define a second space. The first space and second space communicate with each other through oil passages for permitting escape of oil from the first space to the second space or from the second space to the first space during movement of the push rod.

5 Claims, 4 Drawing Sheets

HYDRAULIC PILOT VALVE

BACKGROUND OF THE INVENTION

1. Field of the Invention

The present invention relates to pilot valves widely used as a device for controlling hydraulic implements attached to agricultural, construction and other such machinery. More particularly, the invention relates to a pilot valve comprising:

a valve case;

a spool reciprocable within the valve case between a pilot pressure supplying position for interconnecting a pump port and a supply and exhaust port, and an exhaust position for interconnecting a tank port and the supply and exhaust port;

a push rod movable in a first direction within the valve case to move the spool to the supplying position, the push rod including a cylindrical skirt portion adjacent one end thereof having sliding surfaces for sliding relative to the valve case, and a rod portion adjacent the other end, the skirt portion, the rod portion and the valve case defining a first space, the skirt portion, the spool and the valve case defining a second space, the first space and the second space being opposed to each other across the skirt portion;

a balancing spring interposed between the spool and the skin portion for adjusting a pilot pressure;

a return spring for biasing the push rod in a second direction opposite to the first direction; and a control member for acting on the rod portion to move the push rod in the first direction against a biasing force of the return spring.

2. Description of the Related Art

Well-known pilot valves of this type include a crosswise controllable valve as disclosed in Japanese Utility Model Publication Kokai No. 3-17386. This pilot valve has coupling ports defined in a bottom surface of a valve case for connection to piping extending to control valves. Further, supply and exhaust valve mechanisms are provided, each of which includes a spool slidable between one of the coupling ports, and a pump pressure chamber and a tank pressure chamber arranged vertically within the case, and a push rod for receiving one end of the spool and transmitting a force to the spool through a balancing spring for adjusting a pilot pressure. With this construction, the push rod is movable in an amount corresponding to an amount of operation of a control lever. The push rod cooperates with the balancing spring to move the spool, thereby generating a corresponding pilot pressure.

Such pilot valves may be classified into two types based on the push rod structure, which are:

1) the type in which, as shown in FIG. 1 of the above publication, the push rod includes a rod portion (referenced 8) for receiving an operating force from the control lever, and a skirt portion (referenced 6) formed separately from the rod portion for receiving a return spring (referenced 7); and 2) the type in which, as shown in FIG. 2 of the above publication, the rod portion and skirt portion are formed integral with each other.

In the former, combined structure, the rod portion and skirt portion may be manufactured as individual components with ease. However, the two portions must be independently slidable relative to the valve case, but their sliding surfaces are short. This results in disadvantages in terms of smooth sliding movement and shaping precision. In the later, integrated structure, although long sliding surfaces are secured, a space is formed between an upper surface of the skirt portion and a cover member forming part of the valve case when the push rod is depressed, and it is necessary to deal with this space. That is, expansion or compression of this space occurring with movement of the push rod produces a resistance to hinder smooth movement of the push rod.

SUMMARY OF THE INVENTION

A primary object of the present invention is to provide an improvement in a pilot valve having a construction as described in the outset hereof in which the rod portion and skirt portion are formed integral with each other, to enable smooth movement of the push rod.

The above object is fulfilled, according to the present invention, by a pilot valve having communicating means for intercommunicating the first space defined by the skirt portion, rod portion and valve case, and the second space defined by the skirt portion, spool and valve case.

Oil is circulated through the above communicating means, and hence the communicating means permits escape of oil from the first space to the second space or from the second space to the first space during movement of the push rod. In the absence of such communicating means, a negative pressure could be generated in the first space whose capacity increases with depression of the push rod, whereby the depressing operation could become heavy. Further, an excessive pressure could be generated in the first space whose capacity decreases with upward return movement of the push rod under the force of the return spring. This would retard the return movement of the push rod. Thus, the presence of the communicating means promotes operating response of the push rod.

In a preferred embodiment of the invention, the communicating means is in the form of recessed passages formed on the sliding surfaces of the skirt portion of the push rod. These recessed passages act as oil lines extending between the sliding surfaces of the skirt portion and valve case to intercommunicate the first and second spaces. With oil flowing through these oil lines, the first space is smoothly expandable and compressible to enable smooth movement of the push rod.

Instead of the sliding surfaces of the skin portion, the recessed passages may be formed on slidable surfaces of the valve case opposed to the sliding surfaces of the skin portion. This will produce the same effect.

In a further preferred embodiment of the invention, the communicating means includes perforations formed in a region of transition from the push rod to the skirt portion. In this case, the push rod may advantageously include a recess opening to the second space and extending from the skin portion to the rod portion, the perforations intercommunicating the first space and the recess. In any case, oil may easily flow through the communicating means between the first and second spaces to diminish the resistance due to expansion or compression of the first space, thereby promoting responsivity of the push rod.

Other features and advantages of the present invention will be apparent from the following description of the preferred embodiments taken in conjunction with the drawings.

DETAILED DESCRIPTION OF THE PREFERRED EMBODIMENT

An embodiment of the present invention will be described with reference to the drawings. In this embodiment, a hydraulic pilot valve is employed in a hydraulic control system for a backhoe.

Figure 1:
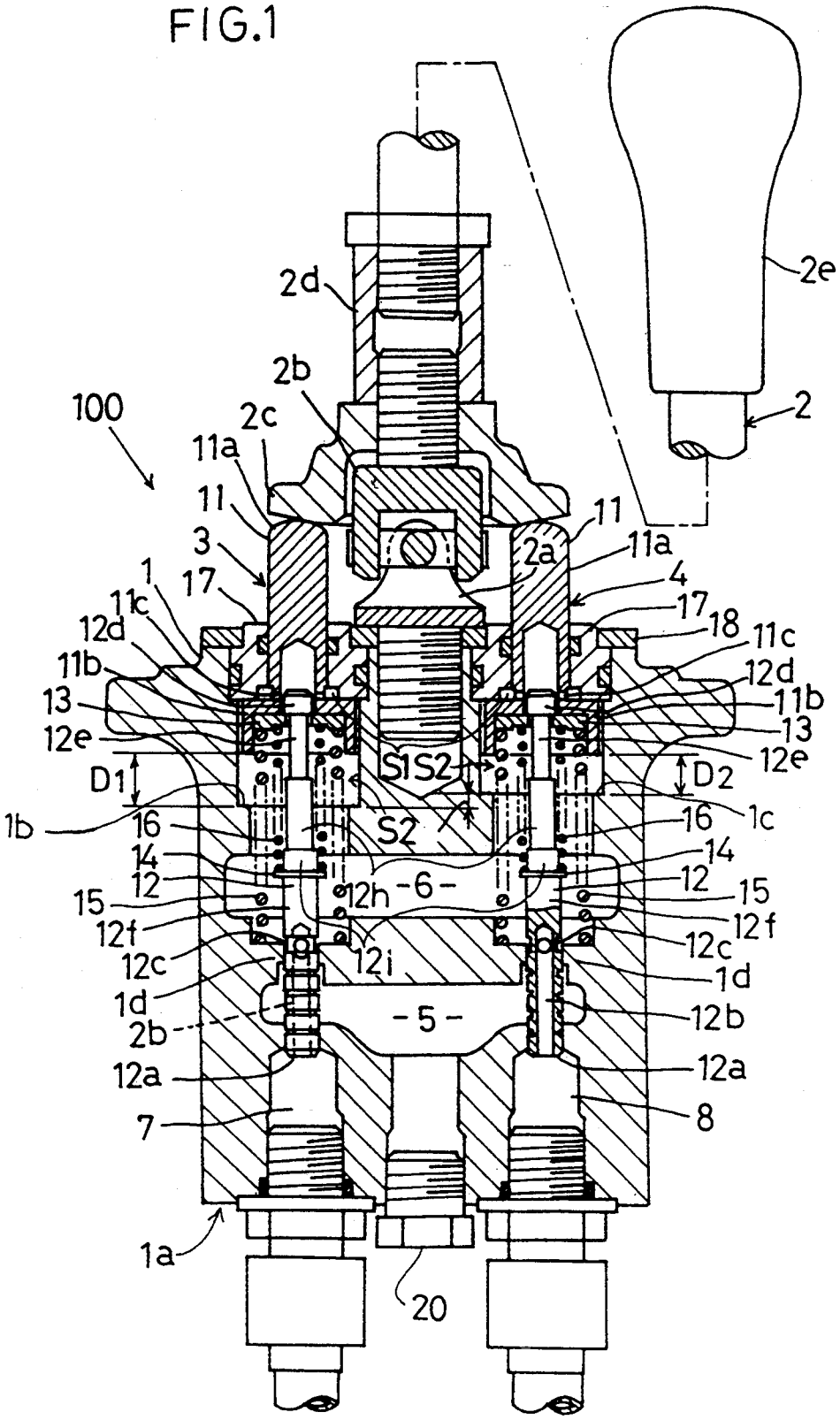
FIG. 1 is an exploded sectional view of a pilot valve according to the present invention.
Figure 2:
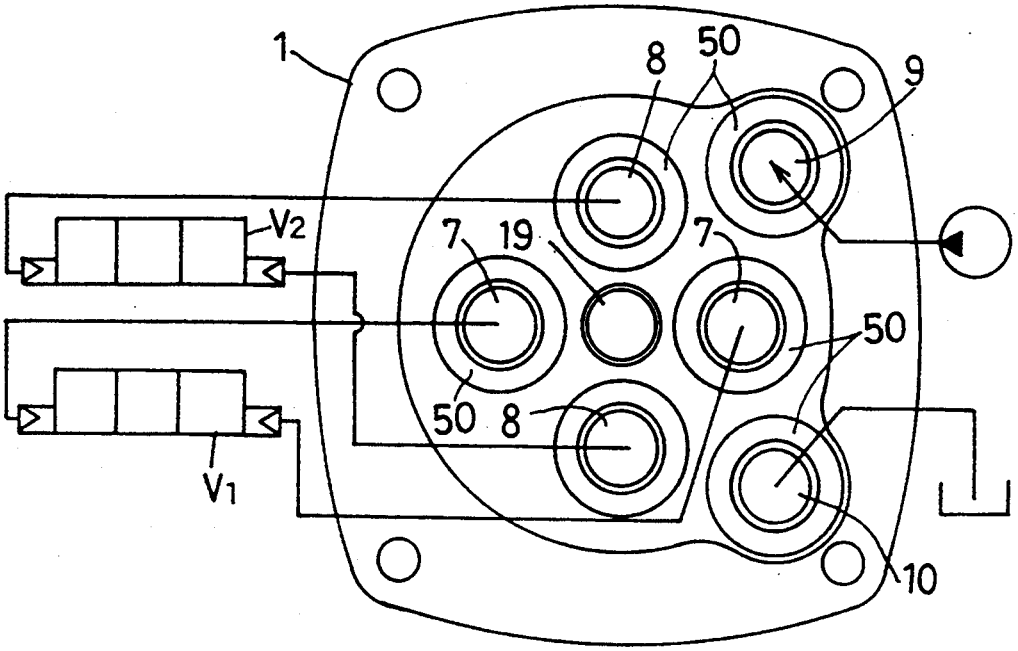
FIG. 2 is a bottom view of the pilot valve shown in FIG. 1.
Figure 3:
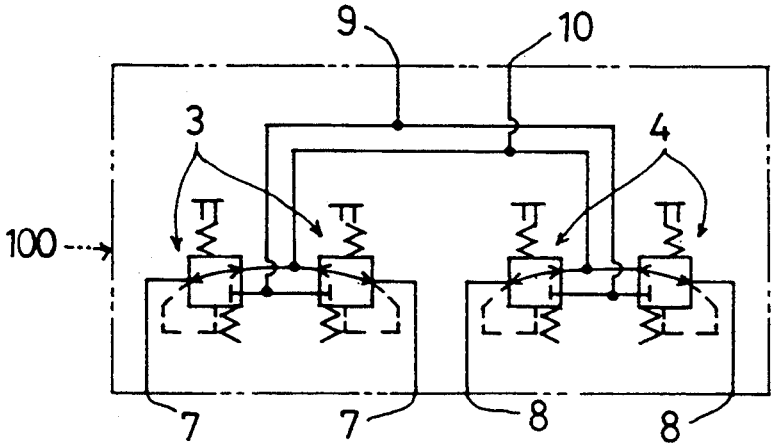
FIG. 3 is a hydraulic circuit diagram showing a symbol of the pilot valve.

FIGS. 1 and 2 show a pilot valve 100 operable crosswise for switching a boom control valve V1 and a bucket control valve V2. The pilot valve 100 includes a valve case 1, a control lever 2, first supply and exhaust valve mechanisms 3 associated with a boom, second supply and exhaust valve mechanisms 4 associated with a bucket, a pump pressure chamber 5, a tank pressure chamber 6, supply and exhaust ports 7 associated with the boom, supply and exhaust ports 8 associated with the bucket, a pump port 9, and a tank port 10. FIG. 3 shows, for reference, a symbol of the pilot valve 100 in a hydraulic circuit.

The control lever (acting as a control member) 2 includes a proximal portion 2*a* screwed to the valve case 1, an operative portion 2*b* connected to the proximal portion 2*a* through a universal joint structure, a dish-shaped control portion 2*c*, a coupling tube 2*d*, and a lever portion 2*e*. The operator may grip the lever portion 2*e* to operate the control lever 2 crosswise. For expediency of illustration, FIG. 1 shows a second supply and exhaust valve mechanism 4 in place of one of the first supply and exhaust valve mechanisms 3.

The first and second supply and exhaust valve mechanisms 3 and 4 have an identical structure including a push rod 11, a spool 12, an upper, first spring bearing 13, a lower, second spring bearing 14, a first coil spring (acting as a return spring) 15 for returning the push rod 11, and a second coil spring (acting as a balancing spring) 16 for adjusting a pilot pressure. Each of these valve mechanisms 3 and 4 is mounted in the valve case 1 and retained in place by a plug 17. The four plugs 17 are retained by a cover plate 18 fixed to an upper surface of the valve case 1 by the proximal portion 2*a*.

The push rod 11 includes a rod portion 11*a* depressible by the control portion 2*c*, and a hollow cylindrical skirt portion 11*b* formed integral with the rod portion 11*a* and slidably supported in the valve case 1. The push rod 11 is smoothly slidable up and down by means of an upper slide region defined by the plug 17 and rod portion 11*a* and a lower slide region defined by the skirt portion 11*b* and a skin sliding hole 1*e* in the valve case 1.

Figure 4A:
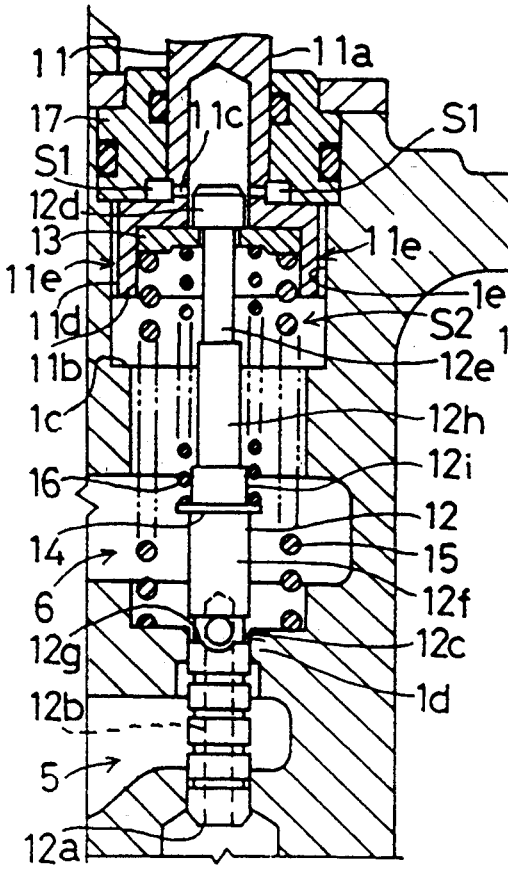
FIG. 4*a* is an enlarged sectional view of a structure adjacent a lower portion of a spool in a state where a push rod lies in an upper position.
Figure 4B:
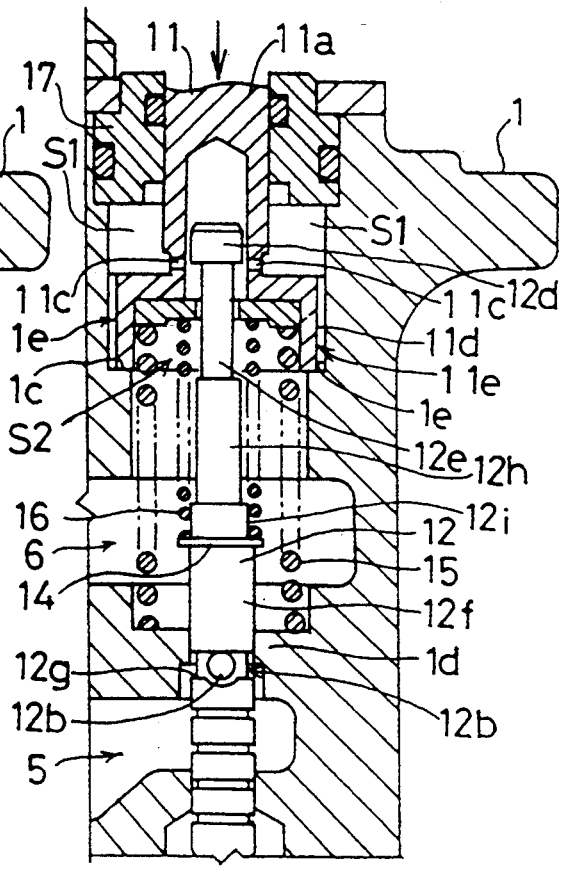
FIG. 4*b* is an enlarged sectional view of the structure adjacent the lower portion of the spool in a state where the push rod lies in a lower position.
Figure 5:
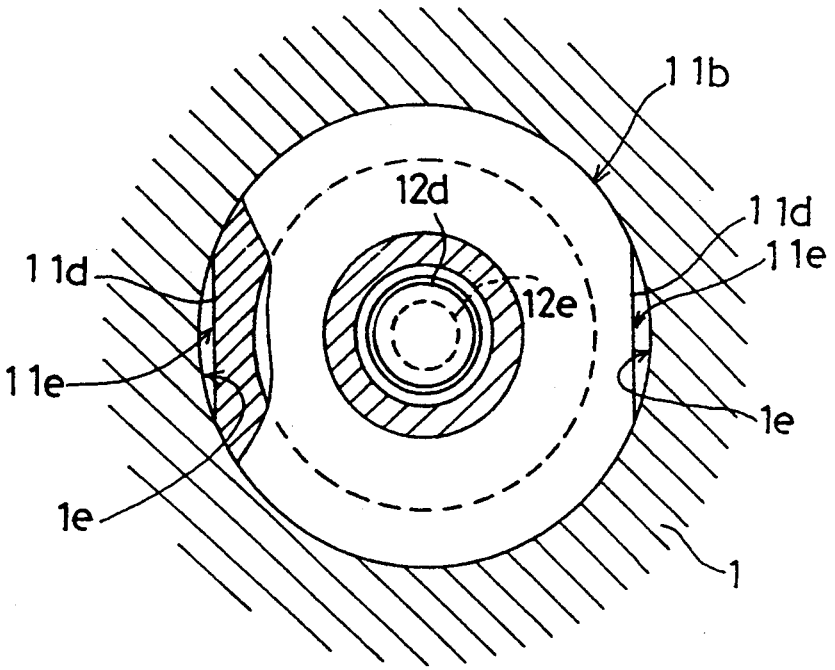
FIG. 5 is a sectional plan view of a skirt portion of the push rod with recessed passages formed on sliding surfaces thereof.

As shown in FIGS. 4*a*, 4*b* and 5, the skin portion 11*b* includes two cut surfaces 11*d* formed peripherally thereof. The cut surfaces 11*d* define recessed passages 11*e* for communicating a first space S1 defined above the skin portion 11*b* by an upper surface of the skin portion 11*b*, rod portion 11*a* and valve case 1, with a second space S2 defined below the skin portion 11*b* by a lower surface of the skin portion 11*b* and valve case 1. Further, two transverse perforations 11*c* are formed in a region of transition from the rod portion 11*a* to the skin portion 11*b*, i.e. at a lower end of the rod portion 11*a*. These perforations communicate the first space S1 with the second space S2, as do the recessed passages 11*e*. These communicating oil passages allow oil to flow into and out of the first and second spaces when the push rod 11 is depressed or raised. This feature provides a light feeling of operation when depressing the push rod 11, and promotes a smooth return of the push rod 11 by action of the first coil spring 15.

A lower portion of the spool 12 defines a communicating bore 12*b* for communicating a lower end 12*a* thereof with a land 12*c* formed in an intermediate position thereof. An upper portion of the spool 12 defines a slide portion 12*d* slidably fitted in the push rod 11, and a washer fitting shank portion 12*e* having a small diameter for attaching the first spring bearing 13. An intermediate portion of the spool 12 defines a medium diameter shank portion 12*f* for providing a shoulder for supporting the second spring bearing 14. The spool 12 further includes a guide shank portion 12*h* for guiding the first coil spring 16, and a restrictive shank portion 12*i* formed at a lower end of the guide shank portion 12*h* and having a slightly larger diameter than the guide shank portion 12*h* for effectively restricting slippage of a lower end of the first coil spring 16.

As shown in FIG. 2, four supply and exhaust ports, i.e. a pair of supply and exhaust ports 7 associated with the boom and a pair of supply and exhaust ports 8 associated with the bucket, are arranged to form a square on a bottom surface 1*a* of the valve case 1. The pump port 9 and tank port 10 are arranged at opposite sides. Each port has a bearing surface (acting as a hydraulic piping coupling) 50 shaped to couple piping.

The pump port 9 communicates with the flat pump pressure chamber 5 through a curved supply passage (not shown) opening to a lateral position of the pump pressure chamber 5. The tank port 9 communicates with the tank pressure chamber 6 through a curved exhaust passage (not shown) opening to a lateral position of the tank pressure chamber 6. This exhaust passage extends around the pump pressure chamber 5.

An extract bore 19 extending between the bottom surface 1*a* of the valve case 1 and the pump pressure chamber 5 opens centrally of the four supply and exhaust ports 7 and 8. Core sand used in sand molding is efficiently removed from the center of the pump pressure chamber 5 through the extract bore 19. After the core sand is removed, the extract bore 19 is closed with a plug 20.

An outline of operation of the pilot vane 100 will be described in relation to the first supply and exhaust valve mechanism 3. In a free state as shown in FIG. 1, the land 12*c* is exposed to the tank pressure chamber 6, and the lower end of the spool 12 exposed to the supply and exhaust port 7. Thus, the corresponding supply and exhaust port 7 is in communication with the tank port 10, to place the control valve V1 in neutral position.

When the control lever 2 is operated to depress the push rod 11 against the first coil spring 15, the spool 12 is actuated through the second spring 16 to slide downward. As a result, a decreasing portion of the land 12*c* is exposed to the tank pressure chamber 6 to diminish an oil exhausting area. After a predetermined stroke, the land 12*c* is surrounded by a receiving portion 1*d* of the valve case 1 to close the oil passages.

With subsequent tilting of the control lever 2, the spool 12 slides further downward through the second coil spring 16 to expose the land 12*c* to the pump pressure chamber 5. This establishes communication between the supply and exhaust ports 7 and pump port 9, whereby the pilot pressure is applied to the boom control valve V1.

At this time, a difference in area between a shoulder 12*g* of the land 12*c* and the lower end 12*a* of the spool 12 produces a force to push up the spool 12. Then, the spool 12 is held in a position where the upward force balances the resilience of the second coil spring 15 thereby compressed. That is, the second coil spring 16 is compressed correspondingly with an amount of descent of the push rod 11 caused by the control lever 2, and the spool 12 stops at a position in which the downward force due to the resilience of the second coil spring 16 balances the upward force due to the above area difference (see FIG. 4*b*).

Thus, the larger the tilt angle of the control lever 2 becomes, or the larger the amount of downward movement of the push rod 11, the more the second coil spring 16 is compressed. This generates a pilot pressure corresponding to an amount of operation of the control lever 2.

Figure 6:
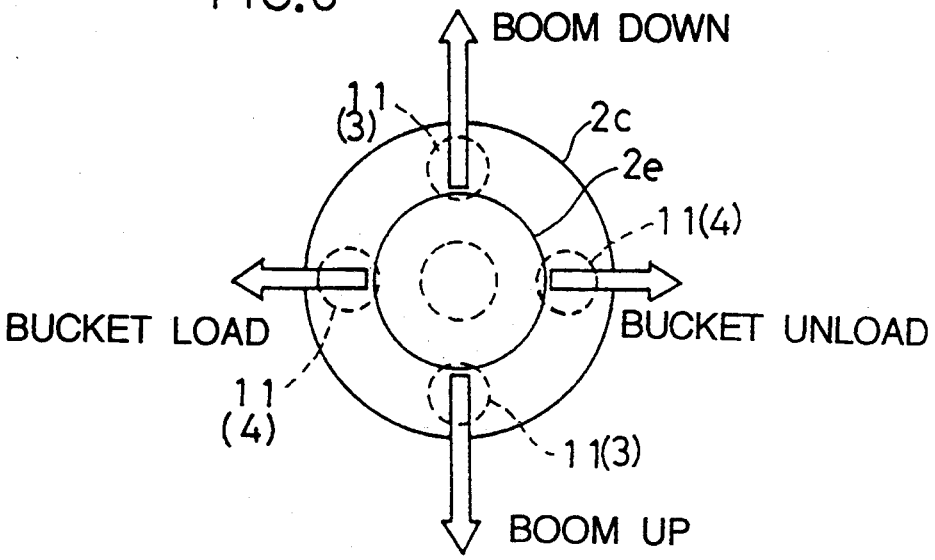
FIG. 6 is a plan view showing an operating mode of a control lever.

As shown in FIG. 6, the first supply and exhaust valve mechanisms 3 are operable by rocking the control lever 2 fore and aft, while the second supply and exhaust valve mechanisms 4 are operable by rocking the control lever 2 right and left. The spools 12 have different maximum amounts of movement for the first supply and exhaust valve mechanisms 3 and for the second supply and exhaust valve mechanisms 4 in view of the facts that the wrist is more difficult to move sideways than in fore and aft directions, and that the bucket control valve V2 has a smaller opening degree than the boom control valve V1. The maximum amount of movement of the spool 12 may effectively be limited in order to reduce the maximum opening degree of the same control valve.

That is, as shown in FIG. 1, the push rods 11 have maximum amounts of depression determined by contact between the lower ends of the skirt portions 11*b* and first and second shoulders 1*b* and 1*c* in the valve case 1. The second shoulder 1*c* of the second supply and exhaust valve mechanism 4 is higher than the first shoulder 1*b* of the first supply and exhaust valve mechanism 3 by a distance "d". Consequently, the push rod 11 of the first supply and exhaust valve mechanism 3 has a maximum amount of movement D1 set to 9.2 mm, while the push rod 11 of the second supply and exhaust valve mechanism 4 has a maximum amount of movement D2 set to 7.0 mm. This difference results in a fore and aft stroke of the control lever 2 slightly larger than a sideways stroke thereof.

Figure 7:
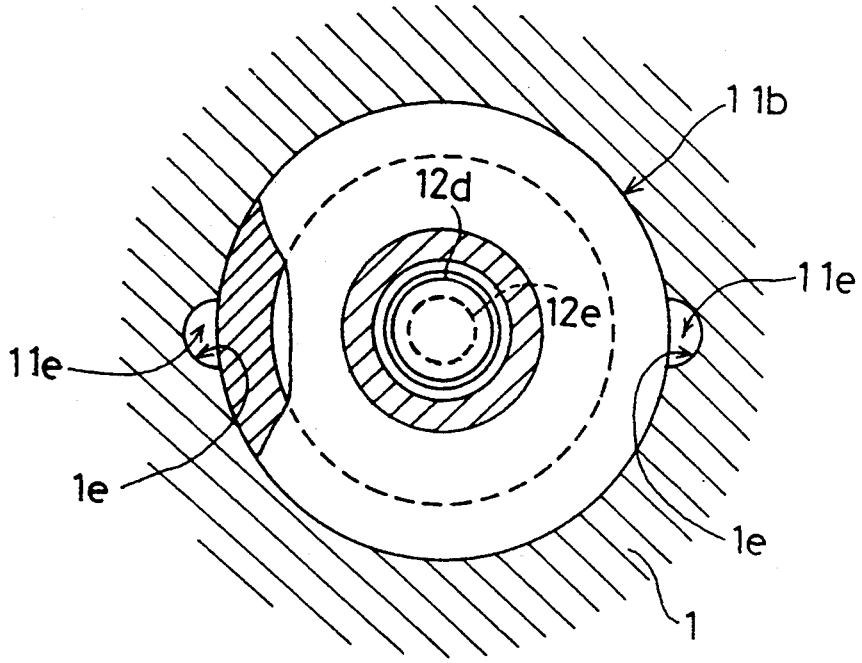
FIG. 7 is a sectional plan view of a push rod showing modified recessed passages formed in slide surfaces of a valve case.

FIG. 7 shows modified recessed passages 11*e* which are formed in the valve case 1. In this case, the recessed passages 11*e* may have a sectional area selected relatively freely with little consideration made as to strength or space. Thus, this modification allows the push rod 11 to include no perforations 11*c*.

What is claimed is:

1. A pilot valve comprising:

a valve case;

a spool reciprocable within said valve case between a pilot pressure supplying position for interconnecting a pump port and a supply and exhaust port, and an exhaust position for interconnecting a tank port and said supply and exhaust port;

a push rod movable in a first direction within said valve case to move said spool to said supplying position, said push rod including a cylindrical skirt portion adjacent one end thereof having sliding surfaces for sliding relative to said valve case, and a rod portion adjacent the other end, said rod portion including a recess to receive a top portion of the spool, said skirt portion, said rod portion and said valve case defining a first space, said skirt portion, said spool and said valve case defining a second space, said first space and said second space being opposed to each other across said skirt portion;

a balancing spring interposed between said spool and said skirt portion for adjusting a pilot pressure;

a return spring for biasing said push rod in a second direction opposite to said first direction;

a control member for acting on said rod portion to move said push rod in said first direction against a biasing force of said return spring;

a communicating passage defined between said skirt portion and said valve case for communicating said first space with said second space, in order to permit escape of oil from said first space to said second space or from said second space to said first space during movement of said push rod; and a perforation formed in said rod portion for communicating said first space with said recess, in order to permit escape of oil from said first space to said recess or from said recess to said first space during movement of said push rod.

2. A pilot valve as defined in claim 1 wherein said communicating passage is formed on sliding surfaces of said skirt portion.

3. A pilot valve as defined in claim 1 wherein said communicating passage is formed on slide surfaces of said valve case opposed to sliding surfaces of said skirt portion.

4. A pilot valve as defined in claim 3 wherein said recessed passage is formed adjacent to a region of transition from said push rod to said skirt portion.

5. A pilot valve as defined in claim 1 wherein said recess opens to said second space.

* * * * *

UNITED STATES PATENT AND TRADEMARK OFFICE

CERTIFICATE OF CORRECTION

PATENT NO. : 5,433,249

DATED : July 18, 1995

INVENTOR(S) : TSUBOTA et al.

It is certified that error appears in the above-indentified patent and that said Letters Patent is hereby corrected as shown below:

On the title page, item [21], the filing date of the above-referenced patent is:

March 28, 1994 NOT March 29, 1994

Signed and Sealed this

Twenty-eighth Day of November 1995

*Attest:*

Bruce Lehman

BRUCE LEHMAN

*Attesting Officer*

*Commissioner of Patents and Trademarks*